US005639582A

United States Patent [19]

Imai et al.

[11] Patent Number: 5,639,582

[45] Date of Patent: Jun. 17, 1997

[54] ELECTROPHOTOGRAPHIC TONER COMPOSITION AND PROCESS FOR THE PREPARATION THEREOF

[75] Inventors: Takashi Imai; Takeshi Agata, both of Minami-ashigara, Japan

[73] Assignee: Fuji Xerox Co., Ltd., Tokyo, Japan

[21] Appl. No.: 527,086

[22] Filed: Sep. 12, 1995

[30] Foreign Application Priority Data

Sep. 16, 1994 [JP] Japan ..... 6-221592

[51] Int. Cl.[6] ..... G03G 9/093; G03G 9/097

[52] U.S. Cl. ..... 430/110; 430/138; 430/137

[58] Field of Search ..... 430/110, 138, 430/137

[56] References Cited

U.S. PATENT DOCUMENTS 4,568,625 2/1986 Uchiyama et al. ..... 430/110
4,780,390 10/1988 Hosoi ..... 430/138
4,845,007 7/1989 Hyosu et al. ..... 430/110
4,876,169 10/1989 Gruber et al. ..... 430/110

FOREIGN PATENT DOCUMENTS 59-197048 11/1984 Japan .
63-271369 11/1988 Japan .

*Primary Examiner*—Roland Martin
*Attorney, Agent, or Firm*—Oliff & Berridge

[57] ABSTRACT

An electrophotographic toner composition which can fix an electrostatic latent image without causing offset in the presence of a small amount of a fuser oil or in the absence of fuser oil in the heat roll fixing process. In a first embodiment, the electrophotographic toner composition comprises a binder resin, a coloring agent, a silicone oil and a silicone-modified resin. In a second embodiment, the electrophotographic toner composition is a capsule toner composition which comprises (a) a core substance containing a binder resin, a coloring agent, a silicone oil and a silicone-modified resin, and (b) a shell surrounding the core Substance. Also disclosed is a process for the preparation of the electrophotographic toner composition.

19 Claims, No Drawings

ELECTROPHOTOGRAPHIC TONER COMPOSITION AND PROCESS FOR THE PREPARATION THEREOF

FIELD OF THE INVENTION

The present invention relates to an electrophotographic toner composition for use in the development of an electrostatic latent image in electrophotographic process, electrostatic recording process, etc. Further, the present invention relates to a process for the preparation thereof.

BACKGROUND OF THE INVENTION

In recent years, copying machines and printers utilizing electrophotography have made a remarkable progress in digitization and color printing. In the case of full-color images, a binder resin having a relatively low molecular weight is used to provide an enhanced color developability and a good fixability at low temperatures. However, if a such a low molecular binder resin is used and a heat roll fixing process is employed, an offset in which a toner is adhered to the heat roll can easily occur. In order to avoid this phenomenon, a process in which a fuser oil such as silicone oil is supplied onto a heat roll is employed.

However, the use of a fuser oil is disadvantageous in that the fuser oil is adhered to a recording medium such as a paper and a film for over head projector (OHP), to thereby stain hands and reduce the writability of copied matters by ball-point pen, pencil and felt-tipped marker.

In order to solve these disadvantages, JP-A-59-197048 (The term "JP-A" as used herein means an "unexamined published Japanese patent application") proposes a method which comprises incorporating a specific silicone oil in a toner mainly composed of a binder resin and a coloring agent to provide an enhanced offset resistance. Further, JP-A-63-271369 proposes a method for providing an enhanced offset resistance in which the softening point of the surface of the toner is raised than that of the core of the toner and a silicone oil is incorporated in the core.

However, these methods are disadvantageous in that the silicone oil and the binder resin have a poor compatibility with each other, thereby causing the silicone oil to migrate to the surface of the toner, toner blocking with time or chargeability change to deteriorate an image, etc.

SUMMARY OF THE INVENTION

Therefore, an object of the present invention is to provide an electrophotographic color toner composition which can be fixed without causing offset in the presence of a small amount of a fuser oil or in the absence of a fuser oil in the heat roll fixing process.

Another object of the present invention is to provide an electrophotographic toner composition which can be fixed and color developed at low temperatures.

A further object of the present invention is to provide an electrophotographic toner composition which exhibits an excellent chargeability without causing blocking with time.

A still further object of the present invention is to provide a process for the preparation of an electrophotographic toner having the above described physical properties.

These and other objects of the present invention will become more apparent from the following detailed description and examples.

The above described objects of the present invention can be accomplished by the following embodiments:

(1) An electrophotographic toner composition, which comprises a binder resin, a coloring agent, a silicone oil and a silicone-modified resin.

(2) An electrophotographic capsule toner composition, which comprises (a) a core substance containing a binder resin, a coloring agent, a silicone oil and a silicone-modified resin, and (b) a shell surrounding the core substance.

(3) The electrophotographic toner composition according to the embodiment (1) or (2), wherein the silicone-modified resin comprises one or more resins selected from the group consisting of polyester/silicone copolymer, silicone graft polyester, and polylactone-modified polysiloxane.

(4) The electrophotographic toner composition according to the embodiment (3), wherein the silicone-modified resin has a weight-average molecular weight of from 1,000 to 10,000.

(5) The electrophotographic toner composition according to any one of the embodiments 1 to 4, wherein the electrophotographic toner composition contains the silicone-modified resin in an amount of from 0.1 to 50% by weight based on the weight of the silicone oil.

(6) The electrophotographic toner composition according to the embodiments (1) or (2), wherein the silicone oil has a boiling point of not lower than 150° C.

(7) The electrophotographic toner composition according to the embodiment (6), wherein the silicone oil comprises one or more silicone oils selected from the group consisting of dimethyl silicone oil, methyl hydrogen silicone oil, and methyl phenyl silicone oil.

(8) The electrophotographic toner composition according to the embodiment (6) or (7), wherein the electrophotographic toner composition contains the silicone oil in an amount of from 1 to 30% by weight based on the weight of the binder resin.

(9) The electrophotographic toner composition according to the constitution (2), wherein the shell comprises at least one of a polyurea resin and a polyurethane resin.

(10) The electrophotographic toner composition according to the constitution (2), wherein the shell comprises at least one of an epoxyurea resin and an epoxyurethane resin.

(11) A process for the preparation of an electrophotographic capsule toner composition comprising (a) a core substance containing a binder resin, a coloring agent, a silicone oil and a silicone-modified resin, and (b) a shell surrounding said core substance., which comprises:

dissolving or dispersing said core substance in a solvent;

providing a first and a second capsule shell-forming monomers;

adding said first capsule shell-forming monomer to said solution or dispersion to form a mixture;

dispersing said mixture in an aqueous medium to form oil droplets; and allowing said oil droplets to undergo polymerization with said second shell-forming monomer present in the water at its interface with said aqueous medium while expelling said solvent present in said oil droplets from the system to form a shell surrounding said core substance.

DETAILED DESCRIPTION OF THE INVENTION

In order to fix a toner without causing offset in the presence of a small amount of a fuser oil or in the absence of a fuser oil in a heat roll fixing process, it is necessary that a silicone oil is supplied from the toner onto a fuser roll during fixing. However, a silicone oil has a poor dispersibility in a binder resin. Therefore, when a silicone oil is incorporated in the toner as it is, the silicone oil oozes out of the surface of the toner with time, causing chargeability change or toner blocking.

In the present invention, a silicone-modified resin is incorporated to an electrophotographic toner composition comprising a binder resin, a coloring agent and a silicone oil to improve the dispersibility of the silicone oil in the binder resin and hence homogeneously and finely disperse the silicone oil in the composition, thereby making it possible to prevent the silicone oil from oozing out of the surface of the toner except during fixing. If the silicone-modified resin is not used, the dispersed diameter of a silicone oil in a toner is restricted to from 1 to 3 μm. On the contrary, if the silicone-modified resin is used, the dispersed diameter of the silicone oil in the toner is on the order of submicron, i.e., not more than 0.9 μm. In order to accomplish such a high dispersion, it is necessary that the stirring speed is kept at generally not less than 1,000 rpm, preferably not less than 5,000 rpm.

The capsule toner of the present invention comprises a core substance comprising a binder resin containing a coloring agent, a silicone oil and a silicone-modified resin incorporated in the binder resin. In this arrangement, the silicone oil can be finely dispersed in the core substance, thereby making it possible to fully cover the surface of the core substance by a resin shell. Further, since no silicone oil presents on the surface of the toner, a good powder fluidity can be maintained, thereby making it possible to provide an electrophotographic toner which undergoes no change of properties due to thermal and mechanical stress with time.

The silicone oil for use in the present invention is generally a silicone oil which stays in liquid state at ordinary temperature (25° C.). Examples thereof include straight silicone oil such as dimethyl silicone oil, methyl hydrogen silicone oil and methyl phenyl silicone oil, and modified silicone oil such as amino-modified silicone oil, epoxy-modified silicone oil, carboxyl-modified silicone oil, carbinol-modified silicone oil, methacryl-modified silicone oil, mercapto-modified silicone oil, polyether-modified silicone oil, methylstyryl-modified silicone oil, alkyl-modified silicone oil, higher fatty acid silicone oil, fluorine-modified silicone oil and higher fatty acid-containing silicone oil. These silicone oils may be used alone or in combination of two or more thereof. Of these, preferred silicone oils are dimethyl silicone oil, methyl hydrogen silicone oil and methyl phenyl silicone oil, which exhibit good releasability from the fuser roll.

Since the boiling point of the silicone oil for use in the present invention has an effect on the blocking tendency of the toner, the boiling point of the silicone oil is preferably not less than 150° C., particularly preferably not less than 200° C. If the boiling point of the silicone oil falls below 150° C., the silicone oil can easily migrate to the surface of the toner.

The addition amount of the silicone oil is from 1 to 50% by weight, preferably from 1 to 30% by weight based on the weight of the binder resin. If the addition amount of the silicone oil falls below 1% by weight, the toner exhibits an insufficient offset resistance. On the contrary, if the addition amount of the silicone oil exceeds 50% by weight, the toner exhibits a reduced strength to thereby cause deterioration due to thermal and mechanical stress in the copying machine.

The viscosity of the silicone oil is from 1 to $10^6$ cSt (at 25° C.), preferably from 1 to $10^4$ cSt (at 25° C.).

The silicone-modified resin for use in the present invention is generally a silicone-modified resin which stays in solid state at ordinary temperature (25° C.). The silicone-modified resin is used for providing a fine dispersion of the silicone oil. The silicone-modified resin is composed of a resin moiety having a high compatibility with the binder resin component and a resin moiety having a high compatibility with the silicone oil. The silicone-modified resin preferably has a weight-average molecular weight of from 2,000 to 100,000.

Examples of the silicone-modified resin include polyester/silicone copolymer, silicone graft polyester, and polylactone-modified polysiloxane. Two or more of the above described silicone-modified resin may be used in combination.

The above described polyester/silicone copolymer has a polyester moiety and a dimethyl polysiloxane moiety. The polyester moiety is generally obtained by polycondensation of a polyvalent carboxylic acid and/or its derivative with a polyvalent alcohol.

Examples of the polyvalent carboxylic acid and/or its derivative include dicarboxylic acid such as naphthalenedicarboxylic acid, phthalic acid, isophthalic acid, terephthalic acid, maleic acid, fumaric acid, citraconic acid, itaconic acid, succinic acid, adipic acid, sebacic acid and azelaic acid; dicarboxylic anhydride such as phthalic anhydride and maleic anhydride; and lower alkyl ester of dicarboxylic acid such as dimethyl terephthalate, dimethyl maleate and dimethyl adipate. Preferred main components of the polyvalent carboxylic acid and/or its derivative include aromatic dicarboxylic acids such as phthalic acid, isophthalic acid and terephthalic acid or its derivatives.

The silicone-modified resin of the present invention may contain 1,2,4-benzenetricarboxylic acid, 2,5,7-naphthalenetricarboxylic acid, an anhydride thereof or a lower alkyl ester thereof in such an amount that no gelatinous substances are produced.

Examples of the above described polyvalent alcohol include diol compounds such as ethylene glycol, propylene glycol, 1,4-butanediol, 1,3-butanediol, 2,3-butanediol, diethylene glycol, dipropylene glycol, triethylene glycol, 1,5-pentanediol, 1,6-hexanediol, neopentyl glycol, 2,2,4-trimethylpentane-1,3-diol, hydrogenated bisphenol A, 2,2-di(4-hydroxyethoxyphenyl) propane and 2,2-di(4-hydroxypropoxyphenyl)propane.

The above described dimethyl polysiloxane moiety of the polyester/silicone copolymer is preferably a compound represented by formula (1):

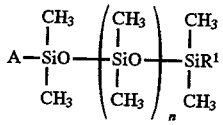

(1)

wherein n represents an integer of from 3 to 100, preferably from 6 to 50; $R^1$ represents a $C_{1-4}$ monovalent hydrocarbon group (in this specification, $C_{p-q}$ represents that the number of carbon atoms contained in the group is from p to g); and A represents an organic group which connects the dimethyl polysiloxane moiety to the polyester moiety.

If n falls below 3, the resulting polyester-silicone copolymer exhibits insufficient releasability, water repellency and slipperiness. On the contrary, if n exceeds 100, the resulting polyester-silicone copolymer exhibits a lowered glass transition point or a reduced solubility in a solvent for forming a coating composition.

Examples of the $C_{1-4}$ monovalent hydrocarbon group represented by $R^1$ include a methyl group, an ethyl group, a n-propyl group, an isopropyl group, a n-butyl group, an isobutyl group, and a tertiary butyl group.

The organic group represented by A is not particularly limited so far as it is a divalent group. However, examples thereof include —R—O—R'—, —COO—R— and —R"—, wherein R, R' and R" each represent an aliphatic or aromatic hydrocarbon group. Specific examples thereof include $—CH_2—O—CH_2CH_2CH_2—$, $—O—CH_2CH_2CH_2—$, $—CH=CH—(CH_2)_8—$, $—CH_2—CH_2—$.

Typical examples of a process for the preparation of the above described polyester-silicone copolymer include the following two processes.

The first preparation process comprises the reaction of a hydroxyl group contained in a polyester with an isocyanate-containing dimethyl polysiloxane as described, for example, in JP-A-4-36325, JP-A-5-43387.

The second preparation process comprises the polycondensation of the above described polyvalent carboxylic acid and/or its derivative with the polyvalent alcohol, accompanied by the copolymerization with a dimethyl polysiloxane, represented by formula (2), which contains a functional group capable of forming two ester bonds at one end.

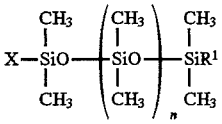

(2)

wherein X represents a monovalent organic group containing a functional group capable of forming two ester bonds; and n and $R^1$ are as defined above. The monovalent organic group represented by X is not particularly limited. However, preferred examples of the above described functional group of X include a dihydroxyl group, a dicarboxyl group, a carboxylic anhydride group, and an epoxy group. Preferred examples of X include

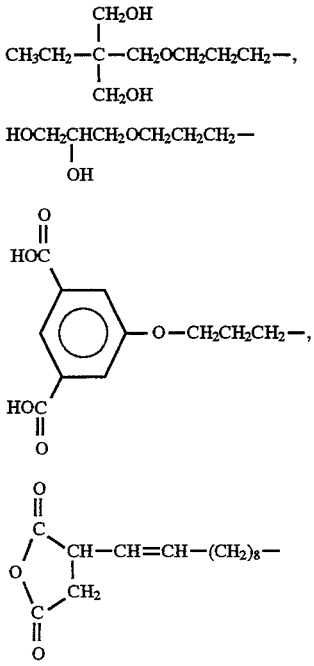

-continued

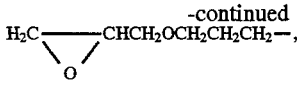

and

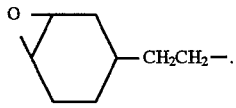

The above described polyester moiety of the polyester/silicone copolymer has a weight-average molecular weight of preferably from 1,000 to 100,000, particularly preferably from 1,000 to 50,000, in polystyrene equivalence as determined by gel permeation chromatography (GPC). If the weight-average molecular weight of the polyester moiety exceeds 100,000, the solubility of the polyester/silicone copolymer in a solvent is disadvantageously reduced.

The proportion of the dimethyl polysiloxane moiety in the polyester-silicone copolymer is preferably from 3 to 90% by weight, particularly preferably from 10 to 80% by weight, based on the weight of the polyester-silicone copolymer for effectively dispersing the silicone oil.

The silicone graft polyester is composed of a polyester as a backbone polymer obtained by the polycondensation of a polyvalent alcohol with a polyvalent carboxylic acid and/or its derivative, and an organopolysiloxane as a superstrate polymer. The same materials used for the above described polyester/silicone copolymer can be used as the polyvalent alcohol and the polyvalent carboxylic acid and/or its derivative. The polyester constituting the backbone polymer preferably has a weight-average molecular weight of from 2,000 to 100,000 in polystyrene equivalence as determined by GPC. If the weight-average molecular weight of the polyester falls below 2,000, the softening point of the silicone graft polyester is considerably lowered. On the contrary, if the weight-average molecular weight of the polyester exceeds 100,000, the silicone graft polyester exhibits a reduced compatibility with the binder resin.

The organopolysiloxane constituting the superstrate polymer is preferably a methyl polysiloxane because it can provide a synthetic resin with excellent releasability, water repellency and slipperiness. The methyl polysiloxane preferably has a weight-average molecular weight of from 200 to 10,000 in polystyrene equivalence as determined by GPC. If the weight-average molecular weight of the methyl polysiloxane falls below 200, it cannot exert a sufficient effect of providing releasability, water repellency and slipperiness. On the contrary, if the weight-average molecular weight of the methyl polysiloxane exceeds 10,000, the resulting silicone graft polyester exhibits a reduced compatibility with the binder resin.

Typical examples of a process for the preparation of the above described silicone graft polyester include the following two processes.

The first preparation process comprises the reaction of a polyester polyol having a hydroxyl group in a side chain thereof with an isocyanate-containing organopolysiloxane as described, for example, in JP-A-4-36325, JP-A-4-293897, JP-A-5-43387.

The second preparation process comprises the polycondensation of the above described polyvalent alcohol with the polyvalent carboxylic acid and/or its derivative, accompanied by the copolymerization with an organopolysiloxane containing a functional group capable of forming two ester bonds at one end.

The above described organopolysiloxane is not particularly limited so far as it contains a functional group capable of forming two ester bonds at one end. However, preferred examples of the above described functional group include diol group, dicarboxyl group, carboxyl anhydride, and epoxy group.

The preferred proportion of the polyester component constituting the backbone polymer to the organopolysiloxane component constituting the superstrate polymer in the silicone graft polyester is from 97/3 to 10/90 by weight, particularly preferably from 90/10 to 20/80 to assure the desired dispersibility of the silicone oil.

The polylactone-modified polysiloxane is a silicone-modified resin represented by formula (3):

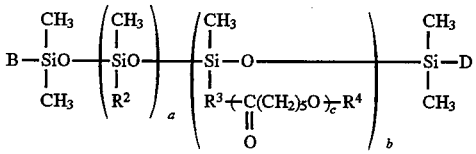

(3)

wherein a plurality of $R^2$ represent the same or different groups selected from the group consisting of a $C_{1-30}$ alkyl group, a substituted or unsubstituted phenyl group and a phenylalkylene group made of a substituted or unsubstituted phenyl group and a $C_{2-3}$ alkylene group; $R^3$ represents a divalent organic group; $R^4$ represents a hydrogen atom, or a $C_{1-10}$ alkyl or acyl group; B and D each represent a $C_{1-4}$ alkyl group or the same or different groups represented by formula (4); a represents an integer of from 3 to 1,000; b represents an integer of from 0 to 50; and c represents an integer of from 5 to 500, providing that when b is 0, at least one of B and D is a group represented by formula (4):

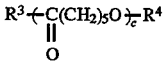

(4)

wherein $R^3$, $R^4$ and c are as defined above.

Examples of $R^2$ include

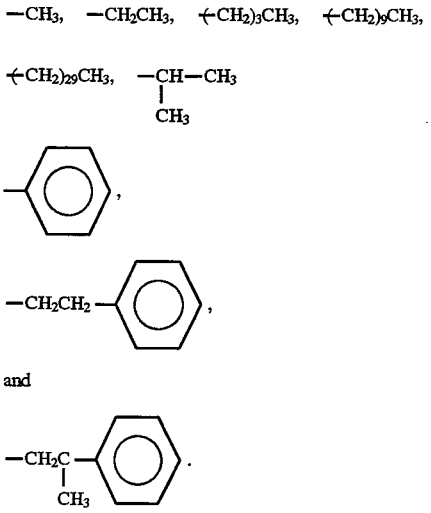

Examples of $R^3$ include

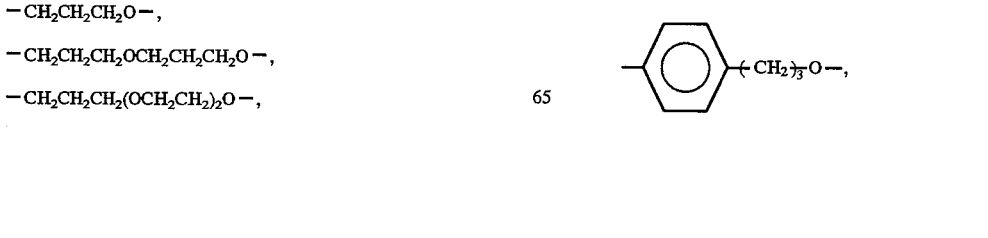

-continued

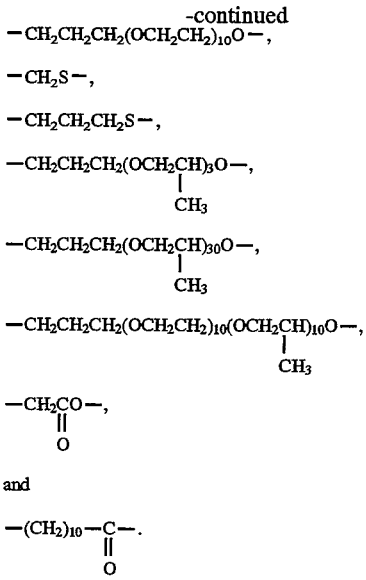

Examples of $R^4$ include

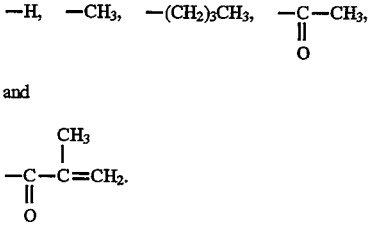

Examples of the substituted phenyl group include

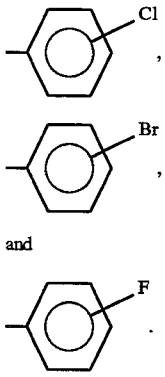

Examples of the phenylalkylene group include

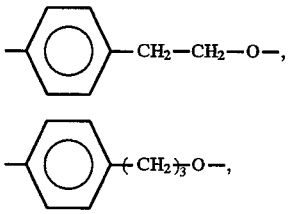

-continued

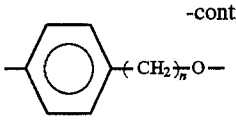

(n is a integer of from 2 to 10), and

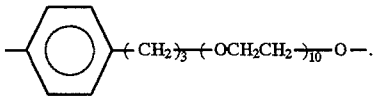

The method for the synthesis of the above described polylactone-modified polysiloxane is not particularly limited. However, a synthesis method comprises the ring opening polymerization of an active hydrogen-containing polysiloxane with ε-caprolactone is preferred.

The polylactone-modified polysiloxane preferably has a volume-average molecular weight of from 2,000 to 100,000, particularly preferably from 5,000 to 50,000, in polystyrene equivalence.

The proportion of the polysiloxane moiety in the polylactone-modified polysiloxane is preferably from 3 to 90% by weight, particularly preferably from 10 to 80% by weight, based on the weight of the polylactone-modified polysiloxane.

The above described silicone-modified resin for use in the present invention is preferably used in an amount of from 0.1 to 50 parts by weight, particularly preferably from 1 to 20 parts by weight, per 100 parts by weight of the silicone oil used. The silicone-modified resin preferably has a softening point (Tm) of from 40° to 120° C.

The binder resin for use in the present invention is not limited so far as it has a good compatibility with the silicone-modified resin. Specific examples of the binder resin include polyester, polyurethane, polyurea, polystyrene, styrene/alkyl methacrylate copolymer, styrene/alkyl acrylate copolymer, styrene/acrylonitrile copolymer, styrene-butadiene copolymer, styrene/maleic anhydride copolymer, polyethylene and polypropylene. These binder resins may be used alone or in combination of two or more thereof in admixture. A polyester resin is preferably used from the standpoint of image intensity, fixability at low temperatures and color developability. The above described binder resin preferably has a weight-average molecular weight of from 3,000 to 300,000.

The above described polyester for the binder resin is preferably a linear polyester obtained by the polycondensation of a polyol component with a polyvalent carboxylic acid, derivative thereof or lower alkyl ester. Preferred examples of the polyol component include a diol represented by formulae (5) and (6):

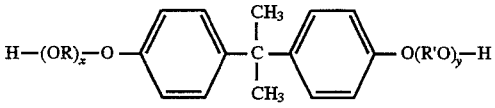

(5)

wherein R and R' each represent an ethylene or propylene group; and x and y each represent an integer of not less than 1.

$$HO(CH_2)_mOH \quad (6)$$

wherein m represents an integer of from 2 to 6.

Preferred examples of the diol represented by formula (5) include polyoxypropylene(2,2)-2,2-bis(4-hydroxyphenyl) propane, and polyoxypropylene(3,3)-2,2-bis(4-hydroxyphenyl)propane.

Preferred examples of the diol represented by formula (6) include ethylene glycol, 1,3-propylene glycol, and 1,4-butanediol.

These diols may be used alone or in combination of two or more thereof in admixture.

Preferred examples of the polyvalent carboxylic acid include divalent carboxylic acids such as phthalic acid, isophthalic acid, terephthalic acid, fumaric acid, maleic acid, and succinic acid; and trivalent carboxylic acids such as 1,2,4-benzenetricarboxylic acid, 2,5,7-naphthalenetricarboxylic acid, and 1,2,4-naphthalenetricarboxylic acid. These polyvalent carboxylic acids may be used alone or in combination of two or more thereof in admixture.

Examples of the coloring agent for use in the present invention include carbon black, nigrosine, aniline blue, calco oil blue, chrome yellow, ultramarine blue, Du Pont oil red, quinoline yellow, methylene blue chloride, phthalocyanine blue, malachite green oxalate, lamp black, rose Bengal, C.I. pigment red 48:1, C.I. pigment red 122, C.I. pigment red 57:1, C.I. pigment yellow 97, C.I. pigment yellow 12, C.I. pigment blue 15:1, and C.I. pigment blue 15:3. Further, a magnetic powder can be used.

Examples of the shell-forming resin constituting the microcapsule toner include epoxy resins, urethane resins, urea resins, polyamide resins, polystyrene resins, poly(meth) acrylic resins, polyester resins, polycarbonate resins, urea-formaldehyde resins, melamine-formaldehyde resins, styrene/(meth)acrylate copolymer resins, gelatin, polyvinyl pyrrolidone, and polyvinyl alcohol.

Of these, polycondensated resins and thermosetting resins such as polyurethane resin, polyurea resin, polyamide resin, polyester resin, and polycarbonate resin are preferred, and further, polyurethane and polyurea are particularly preferred. These resins may be used alone or in combination of two or more thereof.

The shell of the toner can be formed according to an interfacial polymerization method, a phase separation method, an in-situ polymerization method, an orifice method, a coacervation method or the like. Of these, preferred is interfacial polymerization method which comprises allowing a hydrophilic monomer to be present in an aqueous phase having a hydrophobic monomer-containing water-immiscible oil phase dispersed therein in the form of finely divided droplets to effect polymerization at the aqueous phase-oil phase interface.

In the interfacial polymerization process, a core substance is incorporated in the aqueous phase in the form of solution or dispersion in an organic solvent so that the core substance is emulsified in the aqueous phase. Particularly preferred examples of the organic solvent include ethyl acetate, isopropyl acetate, butyl acetate, and methylene chloride.

The aqueous phase for emulsifying the core substance therein may contain a protective colloid. A water-soluble high molecular compound may be used as the protective colloid. Such a water-soluble high molecular compound is properly selected from known anionic, nonionic and amphoteric high molecular compounds. However, of the known high molecular compounds, polyvinyl alcohol, gelatin, and cellulose derivatives are preferred.

The aqueous phase and oil phase may contain a surface active agent. Such a surface active agent which does not cause the protective colloid to precipitate or flocculate is properly selected as the surface active agent for use in the present invention from anionic or nonionic surface active agents. Preferred examples of such a surface active agent include sodium alkylbenzenesulfonates, sodium laurylsulfate, dioctyl sodium sulfosuccinate, and polyalkylene glycol ethers (e.g., polyoxyethylene nonyl phenyl ether).

The shell of the toner can be formed by mechanically emulsifying in an aqueous phase a solution or dispersion of a core substance in an organic solvent, and then forming a high molecular substance film around oil droplets of core substance to produce microcapsules. In this case, a high molecular substance-producing reactive component is added to the interior and/or exterior of the oil droplets. Details of the microcapsulization process which can be preferably used in the present invention are described, for example, in U.S. Pat. Nos. 3,726,504 and 3,796,696.

For example, when a shell made of a polyurethane is formed, a method may be used which comprises incorporating a polyvalent isocyanate as a first component and a second component (e.g., polyol) reactive therewith in an aqueous phase or an oil phase of core substance to be microcapsulized, emulsion-dispersing the mixture in water, and then heating the emulsion dispersion so that an interfacial polymerization reaction occurs at the aqueous phase-oil phase interface to form a shell. When the above described second component is replaced, for example, by a polyamine, a polyurea is produced. When a polyvalent hydroxy compound and a polyamine are used as second components, at least one of polymer composed of urethane and urea each independently polymerized, urethane-urea random copolymer, graft copolymer thereof and block copolymer thereof, are obtained by a known polymerization reaction.

Details of the above described polyvalent isocyanate, and the polyvalent hydroxy compound and polyamine reactive therewith for use in the reaction are disclosed in U.S. Pat. Nos. 3,281,383, 3,773,695 and 3,793,265, JP-B-48-40347 (The term "JP-B" as used herein means an "examined Japanese patent publication"), JP-B-49-24159, JP-A-48-80191, and JP-A-48-84056.

Examples of the polyvalent isocyanate as the first component include diisocyanates such as m-phenylene diisocyanate, p-phenylene diisocyanate, 2,4-tolylene diisocyanate, 2,6-tolylene diisocyanate, naphthalene-1,4-diisocyanate, diphenylmethane-4,4'-diisocyanate, 3,3'-dimethoxy-4,4'-diphenyl diisocyanate, 3,3'-dimethyldiphenylmethane-4,4'-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate and cyclohexylene-1,4-diisocyanate; triisocyanates such as 4,4',4"-triphenylmethane triisocyanate, and toluene-2,4,6-triisocyanate; tetraisocyanate such as 4,4'-dimethyldiphenylmethane-2,2',5,5'-tetraisocyanate; and isocyanate prepolymers such as adduct of hexamethylene diisocyanate and trimethylol propane, adduct of 2,4-tolylene diisocyanate and trimethylol propane, adduct of xylylene diisocyanate and trimethylol propane and adduct of tolylene diisocyanate and hexanetriol.

Examples of the polyvalent hydroxy compound as the second component include aliphatic polyvalent alcohol, aromatic polyvalent alcohol, polyvalent phenol, hydroxypolyester and hydroxypolyalkylene ether. For example, polyvalent hydroxy compounds as disclosed in JP-A-60-49991 can be used.

Specific examples of the polyvalent hydroxy compounds include ethylene glycol, 1,3-propanediol, 1,4-butanediol, 1,5-pentanediol, 1,6-hexanediol, 1,7-heptanediol, 1,8-octanediol, propylenediol, 1,2-butanediol, 1,3-butanediol, 2,3-butanediol, 2,2-dimethyl-1,3-propanediol, 2,4-pentanediol, 2,5-hexanediol, 3-methyl-1,5-pentanediol, 1,4-cyclohexanedimethanol, 1,4-dihydroxycyclohexane, diethylene glycol, glycerin, 1,1,1-trimethylolpropane, hexanetriol, pentaerythritol, ethylene oxide adduct of glycerin, ethylene oxide adduct of pentaerythritol, aromatic polyvalent alcohols such as 2-phenylpropylene glycol, m-xylylene glycol, p-xylylene glycol and α,α'-dihydroxy-p-diisopropylbenzene, alkylene oxide adduct of polyvalent phenol such as 1,3-di(2-hydroxyethoxy) benzene, 1,4-di(2-hydroxyethoxy)benzene, ethylene oxide adduct of bisphenol A and propylene oxide adduct of bisphenol A, and polyvalent phenols such as 4,4-dihydroxydiphenylmethane, bisphenol A and 2-(p,p'-dihydroxydiphenylmethyl)benzylalcohol.

Examples of the polyamine as the second component include ethylenediamine, trimethylenediamine, tetramethylenediamine, pentamethylenediamine, hexamethylenediamine, m-phenylenediamine, p-phenylenediamine, piperazine, 2-methylpiperazine, 2,5-dimethylpiperazine, 2-hydroxytrimethylenediamine, diethylenetriamine, triethylenetetramine, tetraethylenepentamine, diethylaminoethylaminopropylamine, and amine adduct of epoxy compound. Further, water may also be used as the second component. As the second component there may be used water.

The proportion of the hydroxyl group and/or amino group in the second component per mol of the isocyanate group in the first component is preferably from 0.02 to 2 mol.

The microcapsulized toner composition thus prepared is separated from the aqueous phase, washed with water, and then dried to prepare a heat-fixable toner composition. The separation and drying process of the material is generally conducted by drying a slurry containing a microcapsulized toner composition.

The toner composition of the present invention may optionally contain additives such as known electrification controlling agent and fixing aid. The toner composition of the present invention may also contain external additives such as fluidizer (e.g., silica, titania, alumina) and cleaning aid (e.g., polystyrene fine particles, polymethyl methacrylate fine particles, polyvinylidene fluoride fine particles).

The toner composition of the present invention may be used in the form of one-component developer free of carrier or two-component developer having a carrier. In particular, the toner composition of the present invention is preferably used in the form of two-component developer. The carrier, if used, is not particularly limited so far as it is a known carrier. Examples of the carrier for use in the present invention include iron powder carriers, ferrite carriers, surface-coated ferrite carriers, and magnetic powder-dispersed carriers.

The present invention is described in greater detail with reference to the following examples, but the present invention should not be construed as being limited thereto. All parts are by weight unless otherwise noted.

(Synthesis Example of Polyester-Silicone Copolymer)

Into a 1-l capacity glass flask equipped with an agitator, a thermometer, a condenser, an ester adapter and a pressure-reducing device were added 73.2 g (0.3 mol) of dimethyl 2,6-naphthalenedicarboxylate, 135.8 g (0.7 mol) of dimethyl terephthalate, 206.4 g (0.6 mol) of 2,2-di(4-hydroxypropoxyphenyl)propane, 124.0 g (2.0 mol) of ethylene glycol, 0.27 g (0.8 mmol) of tetrabutyl titanate, and 111.4 g (0.2 mol) of an epoxy-containing dimethylpolysiloxane represented by formula (7). The mixture was heated over a mantle heater in a stream of nitrogen so that it underwent demethanolization reaction at a temperature of from 160° C. to 170° C. for 6 hours. The amount of methanol which had been distilled off through the ester adapter was 62.1 g.

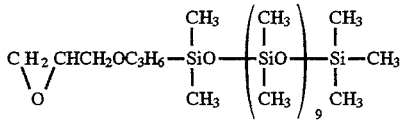

(7)

The reaction system was then heated to a temperature of 220° C. in 1 hour. The reaction system was then allowed to undergo deethylene-glycolation reaction at a temperature of from 220° C. to 240° C. under a 20 mmHg-reduced pressure for 3 hours. The amount of ethylene glycol which had been distilled off was 71.2 g. After the completion of the reaction, the resulting polymer was allowed to cool to room temperature to thereby obtain 386.9 g of a light-brown semitransparent solid. The product had a weight-average molecular weight of 20,000 in polystyrene equivalence as determined by GPC, a glass transition point of 66° C. as determined by DSC (differential thermal analyzer) and a softening point of 115° C. as determined by ring and ball method. The product also exhibited a hydroxyl value of 25.7 mgKOH/g in accordance with JIS K 0070.

The corresponding monomers were a polyvalent carboxylic acid composed of components represented by formula (8) and a polyvalent alcohol composed of components represented by formula (9). The molar ratios of the components are also indicated in the formulae.

The polymer was subjected to quantitative analysis by atomic absorption analysis to determine the content of dimethyl polysiloxane. As a result, the polymer contained a dimethyl polysiloxane content of 19.9% by weight.

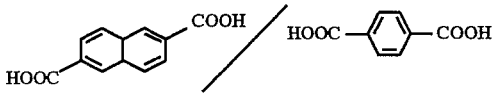

(8)

= 0.31/0.69

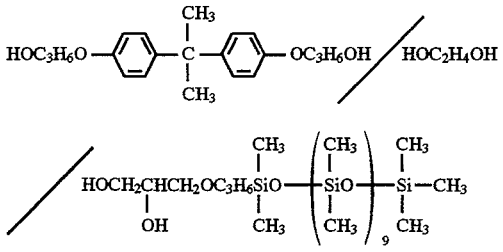

(9)

= 0.39/0.53/0.08

(Synthesis Example of Silicone Graft Polyester)

Into a 1-l capacity glass flask equipped with an agitator, a thermometer, a condenser, an ester adapter and a pressure-reducing device were added 196.6 g of dimethyl terephthalate, 37.5 g of phthalic anhydride, 285.5 g of 2,2-di(4-hydroxypropoxyphenyl)propane, 157.1 g of ethylene glycol, 23.3 g of glycerin, and 0.33 g of tetrabutyl titanate. The reaction mixture was then heated over a mantle heater in a stream of nitrogen so that it underwent demethanolization reaction at a temperature of from 160° C. to 170° C. for 6 hours. The amount of methanol which had been distilled off through the ester adapter was 61.3 g.

The reaction system was then heated to a temperature of 220° C. in 1 hour. The reaction system was then allowed to undergo deethylene-glycolation reaction at a temperature of from 220° C. to 240° C. under a 20 mmHg-reduced pressure as low as 20 mmHg for 3 hours. The amount of ethylene glycol which had been distilled off was 120.4 g. After the completion of the reaction, the resulting polymer was allowed to cool to room temperature to thereby obtain 471.4 g of a light-brown transparent solid polyester polyol. The polyester polyol thus obtained had a weight-average molecular weight of 10,260 in polystyrene equivalence as determined by GPC, a softening point of 122° C. as determined by ring and ball method and a glass transition point of 67° C. as determined by DSC (differential thermal analyzer). The product also exhibited a hydroxyl value of 38.6 mgKOH/g in accordance with JIS K 0070.

Subsequently, into a 1-l capacity glass flask equipped with an agitator, a thermometer and a condenser were added 150 g of the polyester polyol obtained above and 300 g of toluene. The mixture was then heated to a temperature of 60° C. to make a solution. To the solution were then added 0.17 g of dibutyltin dilaurate and 17.8 g of an isocyanate-containing organopolysiloxane represented by formula (10). The reaction mixture was then allowed to undergo reaction at a temperature of 70° C. in a stream of nitrogen for 5 hours. The resulting reaction solution was then subjected to infrared-absorbing analysis. As a result, the absorption at 2,260 $cm^{-1}$ arising from NCO which had been observed before the reaction was found to have disappeared. Further, absorption was observed at 800 $cm^{-1}$, 1,020 $cm^{-1}$, 1,094 $cm^{-1}$ and 1,260 $cm^{-1}$, demonstrating the presence of methyl polysiloxane. From these facts, it was confirmed that the substance obtained by the reaction had been a polyester grafted by organopolysiloxane.

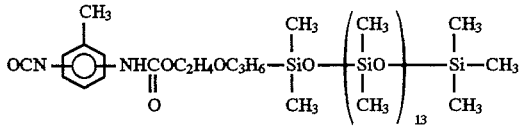

(10)

The reaction solution was then subjected to stripping so that toluene was removed therefrom to obtain 151.2 g of a light-brown semitransparent solid silicone graft polyester.

The silicone graft polyester thus obtained had a weight-average molecular weight of 11,500 in polystyrene equivalence as determined by GPC, a softening point of 97° C. as determined by ring and ball method and a glass transition point of 51° C. as determined by DSC.

(Synthesis Example of Polylactone-Modified Polysiloxane)

Into a 2-l flask were added 510 g (0.1 mol) of a silicone compound represented by formula (11) (hydroxyl value: 22 KOHmg/g) and 684 g (6.0 mol) of ε-caprolactone. To the mixture was then added 0.24 g of tetrabutyl titanate as a catalyst. The mixture was then allowed to undergo reaction at a temperature of from 130° C. to 140° C. with stirring with nitrogen gas being blown thereinto for 10 hours to thereby obtain 1,170 g of a polycaprolactone-modified polysiloxane having a melting point of 54° C. represented by formula (12). The polycaprolactone-modified polysiloxane thus obtained had a weight-average molecular weight of 12,000 in polystyrene equivalence as determined by GPC.

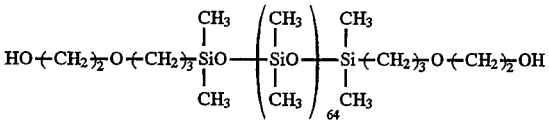

(11)

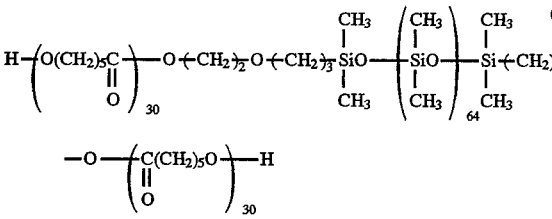

(12)

EXAMPLE 1

Twenty parts by weight of a linear polyester resin (polyester made of propylene oxide adduct of bisphenol A/fumaric acid (Mn: 4,000; Mw: 9,000; Tg: 43° C.; Tm: 80° C.; acid value: 2.7; hydroxyl value: 34.4)), 20 parts by weight of a copper phthalocyanine pigment, and 200 parts by weight of ethyl acetate were mixed in a sand mill to obtain a dispersion. To 15 parts by weight of the dispersion were then added 20 parts by weight of ethyl acetate. To the mixture were then added 19.35 parts by weight of the above described linear polyester, 9 parts by weight of a crosslinked polyester resin (polyester made of ethylene oxide adduct of bisphenol A/propylene oxide adduct of bisphenol A/terephthalic acid/trimellitic anhydride/dodecenylsuccinic acid (Mn: 5,600; Mw: 9,400; Tg: 60° C.; Tm: 115° C.; acid value: 10; hydroxyl value: 20)), 1.5 parts by weight of a dimethyl silicone oil (viscosity at 25° C.: 100 cSt), and 0.15 parts by weight of the copolymer obtained in the above described synthesis example (synthesis of a polyester-silicone copolymer). The mixture was mixed and dissolved to make a solution. The mixture was further stirred by a mixer at 15,000 rpm for 1 minute to provide a fine dispersion of silicone oil. The fine dispersion of silicone oil was then mixed with a shell material composed of 0.9 parts by weight of silyl isocyanate (SI310, available from Matsumoto Trading Co., Ltd.) and 3 parts by weight of adduct of 3 mol of xylylene diisocyanate and 1 mol of trimethylol propane to prepare an oil phase.

Sixty parts by weight of the above described oil phase were then mixed with 120 parts by weight of a 2 wt. % aqueous solution of carboxymethyl cellulose (polymerization degree: 900) by means of a mixer to form an oil-in-water emulsion having an average particle size of 5 μm. To the emulsion were then added 250 parts by weight of a 0.4 wt. % aqueous n-propylamine. The mixture was then allowed to undergo interfacial polymerization reaction with stirring in a 40° C. constant temperature bath, accompanied by the removal of ethyl acetate, for 3 hours. The aqueous n-propylamine was used to control the thickness of the shell. The resulting interfacially-polymerized particles were then processed by a centrifugal separator to remove the aqueous phase therefrom. The particles were then stirred with a washing water to re-disperse the capsule particles. This washing procedure was effected 6 times. The material was then subjected to lyophilization to obtain capsule particles in powder form. To 100 parts by weight of the capsule particles were then added 2 parts by weight of a hydrophobic titanium oxide (T805, available from Nippon Aerosil Co., Ltd.) and mixed to obtain a capsule toner.

The capsule toner was subjected to copying test by a copying machine (A Color, available from Fuji Xerox Co., Ltd.). For the copying test, no fuser oil was supplied so that copying was effected substantially in the absence of fuser oil. As a result, no offset occurred, and a good image was obtained. Similarly, an image was copied on an OHP film. As a result, the OHP film exhibited a good transparency and a good color development was attained. In the above described copying test, the temperature at which fixing begins was examined. As a result, it was 130° C. It was thus found that this capsule toner can fix an image at low temperatures. Further, this capsule toner was subjected to a continuous copying test up to 10,000 sheets. As a result, no image deterioration occurred, and a stable image was obtained.

EXAMPLE 2

A capsule toner was prepared in the same manner as in Example 1 except that the silicone graft polyester obtained in the synthesis example of silicone graft polyester was used in place of the copolymer obtained in the synthesis example of polyester-silicone copolymer. The capsule toner thus obtained was then evaluated in the same manner as in Example 1. As a result, no offset occurred, and a good image was obtained. Similarly, an image was copied on an OHP film. As a result, the OHP film exhibited a good transparency and a good color development was attained. In the above described copying test, the temperature at which fixing begins was examined. As a result, it was 130° C. It was thus found that this capsule toner can fix an image at low temperatures. Further, this capsule toner was subjected to a continuous copying test up to 10,000 sheets. As a result, no image deterioration occurred, and a stable image was obtained.

EXAMPLE 3

A capsule toner was prepared in the same manner as in Example 1 except that the polylactone-modified polysiloxane obtained in the synthesis example of polylactone-modified polysiloxane was used in place of the copolymer obtained in the synthesis example of polyester-silicone copolymer. The capsule toner thus obtained was then evaluated in the same manner as in Example 1. As a result, no offset occurred, and a good image was obtained. Similarly, an image was copied on an OHP film. As a result, the OHP film exhibited a good transparency and a good color development was attained. In the above described copying test, the temperature at which fixing begins was examined. As a result, it was 130° C. It was thus found that this capsule toner can fix an image at low temperatures. Further, this capsule toner was subjected to a continuous copying test up to 10,000 sheets. As a result, no image deterioration occurred, and a stable image was obtained.

COMPARATIVE EXAMPLE 1

A capsule toner was prepared in the same manner as in Example 1 except that the copolymer obtained in the synthesis example of polyester-silicone copolymer was omitted.

The capsule toner thus obtained was then observed under electron microscope. As a result, it was found that the toner had holes on the surface thereof, through which a silicone oil had flown out. The capsule toner was then subjected to copying test in the same copying machine as in Example 1. However, no images were obtained due to the outflow of silicone oil.

EXAMPLE 4

A capsule toner was prepared in the same manner as in Example 3 except that a 80:20 (by weight) copolymer of styrene/n-butyl acrylate (Mn: 6,000; Mw: 21,000; Tg: 49.1° C.) was used in place of the binder resins (linear and cross-linked polyesters) as used in Example 3.

The capsule toner was then examined for dispersibility of the silicone oil dispersed therein under transmission electron microscope. As a result, the silicone oil in the capsule toner was satisfactorily dispersed to have a diameter of as small as about 0.5 μm. The capsule toner was then stored in an atmosphere of 45° C. and 50% RH for 24 hours to examine the blocking tendency thereof. As a result, no blocking occurred, and an extremely good condition had been kept.

The capsule toner was subjected to copying test by a copying machine (A Color, available from Fuji Xerox Co., Ltd.) at a temperature of from 130° C. to 200° C. For the copying test, no fuser oil was supplied so that copying was effected substantially in the absence of fuser oil. As a result, no offset occurred, and a good image was obtained. Similarly, an image was similarly copied on an OHP film. As a result, the OHP film exhibited a good transparency and a good color development was attained. In the above described copying test, the temperature at which fixing begins was examined. As a result, it was 130° C. It was thus found that these capsule toners can fix an image at low temperatures. Further, these capsule toners were each subjected to a continuous copying test up to 10,000 sheets. As a result, no image deterioration occurred, and a stable image was obtained.

EXAMPLE 5

Seventy parts by weight of a linear polyester resin made of propylene oxide adduct of bisphenol A/fumaric acid (Mn: 5,000; Mw: 10,000; Tg: 51° C.; Tm: 100° C.; acid value: 3; hydroxyl value: 30), 30 parts by weight of a crosslinked polyester resin made of ethylene oxide adduct of bisphenol A/propylene oxide adduct of bisphenol A/terephthalic acid/trimellitic anhydride/dodecenylsuccinic acid (Tg: 60° C.; Tm: 115° C.; acid value: 10; hydroxyl value: 20)), 6 parts by weight of a dimethyl silicone oil (KF96–1000, available from Shin-etsu Silicone Co., Ltd.), and 0.12 parts by weight of the polylactone-modified polysiloxane as used in Example 3 were mixed. The mixture was kneaded by a kneader, and then ground to prepare a toner having an average particle diameter of 7 μm.

The toner thus obtained was then evaluated in the same manner as in Example 4. The results are as follows:

Oil dispersibility: 0.4 μm (dispersed diameter as observed under TEM)

Offset resistance: No offset occurred up to 200° C. in the absence of fuser oil.

Blocking tendency: No blocking occurred even after storage at 45° C. and 50% RH.

Fixability at low temperature: Fixable at 150° C.

In accordance with the above described constitution of the present invention, the use of a silicone-modified resin makes it possible to finely disperse a silicone oil in a toner and prevent the silicone oil from oozing out of the surface of the toner. As a result, the offset resistance can be improved. The application of the constitution of the present invention to capsule toners makes it possible to prevent the bleeding of the silicone oil in the core substance and hence improve the blocking resistance of the capsule toners.

While the invention has been described in detail and with reference to specific examples thereof, it will be apparent to one skilled in the art that various changes and modifications can be made without departing from the spirit and scope thereof.

What is claimed is:

1. An electrophotographic toner composition, which comprises a binder resin, a coloring agent, a silicone oil in an amount of 1 to 50% by weight based on the weight of the binder resin and a silicone graft polyester.

2. An electrophotographic capsule toner composition, which comprises (a) a core substance containing a binder resin, a coloring agent, a silicone oil in an amount of 1 to 50% by weight based on the weight of the binder resin and a silicone graft polyester, and (b) a shell surrounding said core substance.

3. The electrophotographic toner composition according to claim 1, wherein said silicone graft polyester has a weight-average molecular weight of from 1,000 to 100,000.

4. The electrophotographic toner composition according to claim 2, wherein said silicone graft polyester has a weight-average molecular weight of from 1,000 to 100,000.

5. The electrophotographic toner composition according to claim 1, wherein said electrophotographic toner composition contains said silicone graft polyester in an amount of from 0.1 to 50% by weight based on the weight of said silicone oil.

6. The electrophotographic toner composition according to claim 2, wherein said electrophotographic toner composition contains said silicone qraft polyester in an amount of from 0.1 to 50% by weight based on the weight of said silicone oil.

7. The electrophotographic toner composition according to claim 1, wherein said silicone oil has a boiling point of not lower than 150° C.

8. The electrophotographic toner composition according to claim 2, wherein said silicone oil has a boiling point of not lower than 150° C.

9. The electrophotographic toner composition according to claim 7, wherein said silicone oil comprises one or more silicone oils selected from the group consisting of dimethyl silicone oil, methyl hydrogen silicone oil, and methyl phenyl silicone oil.

10. The electrophotographic toner composition according to claim 8, wherein said silicone oil comprises one or more silicone oils selected from the group consisting of dimethyl silicone oil, methyl hydrogen silicone oil, and methyl phenyl silicone oil.

11. The electrophotographic toner composition according to claim 7, wherein said electrophotographic toner composition contains said silicone oil in an amount of from 1 to 30% by weight based on the weight of said binder resin.

12. The electrophotographic toner composition according to claim 8, wherein said electrophotographic toner composition contains said silicone oil in an amount of from 1 to 30% by weight based on the weight of said binder resin.

13. The electrophotographic toner composition according to claim 9, wherein said electrophotographic toner composition contains said silicone oil in an amount of from 1 to 30% by weight based on the weight of said binder resin.

14. The electrophotographic toner composition according to claim 10, wherein said electrophotographic toner composition contains said silicone oil in an amount of from 1 to 30% by weight based on the weight of said binder resin.

15. The electrophotographic toner composition according to claim 2, wherein said shell comprises at least one of a polyurea resin and a polyurethane resin.

16. The electrophotographic toner composition according to claim 2, wherein said shell comprises at least one of an epoxyurea resin and an epoxyurethane resin.

17. A process for the preparation of an electrophotographic capsule toner composition, which comprises the steps of:

dissolving or dispersing a core substance containing a binder resin, a coloring agent, a silicone oil in an amount of 1 to 50% by weight based on the weight of the binder resin and a silicone graft polyester in a solvent;

providing a first and a second capsule shell-forming monomers;

adding said first capsule shell-forming monomer to said solution or dispersion to form a mixture;

dispersing said mixture in an aqueous medium to form oil droplets; and then allowing said oil droplets to undergo polymerization with said second shell-forming monomer present in the water at its interface with said aqueous medium while expelling said solvent present in said oil droplets from the system to form a shell surrounding said core substance.

18. The electrophotographic toner composition according to claim 1, wherein said silicone graft polyester comprises a polyester backbone with at least one polysiloxane moiety grafted thereon, said polysiloxane moiety having a compound represented by formula (1):

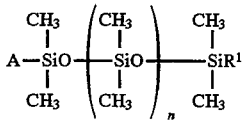

(1)

wherein n represents an integer of from 3 to 100; $R^1$ represents a $C_{1-4}$ monovalent hydrocarbon group; and A represents an organic group that connects the polysiloxane moiety to the polyester backbone.

19. The electrophotographic capsule toner composition according to claim 2, wherein said silicone graft polyester comprises a polyester backbone with at least one polysiloxane moiety grafted thereon, said polysiloxane moiety having a compound represented by formula (1):

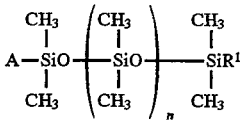

(1)

wherein n represents an integer of from 3 to 100; $R^1$ represents a $C_{1-4}$ monovalent hydrocarbon group; and A represents an organic group that connects the polysiloxane moiety to the polyester backbone.

* * * * *